US006500013B1

(12) United States Patent
Wang

(10) Patent No.: US 6,500,013 B1
(45) Date of Patent: Dec. 31, 2002

(54) CONNECTOR ASSEMBLING STRUCTURE

(75) Inventor: Mei-Hui Wang, Kuishan Hsiang (TW)

(73) Assignee: Speed Tech Corp., Taoyuan (TW)

( * ) Notice: Subject to any disclaimer, the term of this patent is extended or adjusted under 35 U.S.C. 154(b) by 0 days.

(21) Appl. No.: 10/066,602

(22) Filed: Feb. 6, 2002

(51) Int. Cl.[7] ..... H01R 4/66
(52) U.S. Cl. ..... 439/108; 439/610; 439/579
(58) Field of Search ..... 439/607–610, 439/108, 660, 493, 494, 497, 492, 499, 83, 579

(56) References Cited

U.S. PATENT DOCUMENTS 5,667,393 A * 9/1997 Grabbe et al. ..... 439/83
5,882,212 A * 3/1999 McHugh et al. ..... 439/74
5,971,809 A * 10/1999 Ho ..... 439/660
6,007,352 A * 12/1999 Azuma et al. ..... 439/108
6,171,134 B1 * 1/2001 Lai ..... 439/405
6,213,810 B1 * 4/2001 Okano ..... 439/497
6,267,624 B1 * 7/2001 Wu et al. ..... 439/607
6,273,753 B1 * 8/2001 Ko ..... 439/579
6,319,060 B1 * 11/2001 Wu ..... 439/607
6,394,841 B1 * 5/2002 Matsuura ..... 439/607
6,402,554 B1 * 6/2002 Yeh ..... 439/607

* cited by examiner

*Primary Examiner*—Tho D. Ta
*Assistant Examiner*—Ross Gushi
(74) *Attorney, Agent, or Firm*—Troxell Law Office PLLC

(57) ABSTRACT

Connector assembling structure including a connector main body and an insertion seat assembled therewith. An insulating seat of the main body has a hollow projecting section under bottom side. A top side of the insulating seat is formed with a central recess in which multiple opposite transverse channels are arranged at intervals. The transverse channels parallelly extend in reverse directions. The horizontal sections of two rows of L-shaped terminals are oppositely inlaid in the transverse channels. The vertical sections of the terminals downward extend to the inner edge of the projecting section. An upper and a lower covers mate with and cover the upper and lower sides of the insulating seat to clamp and locate the signal ends of multiple coaxial cables and make the signal ends contact with the horizontal sections.

36 Claims, 7 Drawing Sheets

CONNECTOR ASSEMBLING STRUCTURE

BACKGROUND OF THE INVENTION

The present invention is related to a connector assembling structure, and more particularly to a coaxial cable connector which is integrally processed and can be easily assembled. The volume of the connector is effectively reduced.

It is a trend to minimize the volume of electric or electronic connector and demand higher electric properties thereof. Also, in order to increase production efficiency and facilitate assembly of the connector, it is tried by manufacturers to design simpler structure within a limited space and manufacture the connector at lower cost while achieving more precisely electric connection.

The electric connecting structure of a conventional mini coaxial cable includes two board-to-board connectors respectively soldered on an adapting board and a circuit board. A mini coaxial cable is soldered on the adapting board. By means of the board-to-board connectors, the mini coaxial cable can be electrically connected with the circuit board. With respect to such structure, the cost for the components is relatively high and it is complicated to process the structure. Moreover, the board-to-board connectors are not specifically designed for the mini coaxial cable. Therefore, it is necessary to select different types of board-to-board connectors in accordance with different height restrictions. It increases inconvenience in management of stored products.

Recently, a connector specifically designed for the mini coaxial cable has been developed. In manufacturing, a specific tool is used to press and inlay the respective terminals into an insulating seat. The width of the connector is varied with the number of the terminals. Therefore, when manufacturing connectors with different widths, it is necessary to replace the specific tool with another one. It is troublesome to replace the tool and the replacement will lower the production efficiency.

SUMMARY OF THE INVENTION

It is therefore a primary object of the present invention to provide a connector assembling structure including a connector main body and an insertion seat. The center of an insulating seat of the main body are formed with multiple transverse channels which are arranged in parallel to each other. Two notches are formed on the periphery of the top side of the insulating seat in positions to which the lines of terminal insertion holes are directed. Accordingly, a longer tool can be co-used to press down and locate the terminals without being obstructed. Therefore, it is unnecessary to use a specific processing tool so that the production procedure and implements are simplified and the manufacturing cost is lowered.

It is a further object of the present invention to provide the above connector assembling structure in which each terminal is substantially L-shaped, having a horizontal section and a vertical section which are respectively positioned on two sides away from a central line of the terminal. Accordingly, when the terminals are oppositely arranged in two lines, the vertical sections of the terminals are symmetrically arranged, while the horizontal sections are interlaced. Therefore, in unit length, the number of the arranged terminal (density) is increased so that the connector can have smaller volume and lighter weight.

The present invention can be best understood through the following description and accompanying drawings wherein:

DETAILED DESCRIPTION OF THE PREFERRED EMBODIMENTS

Figure 1:
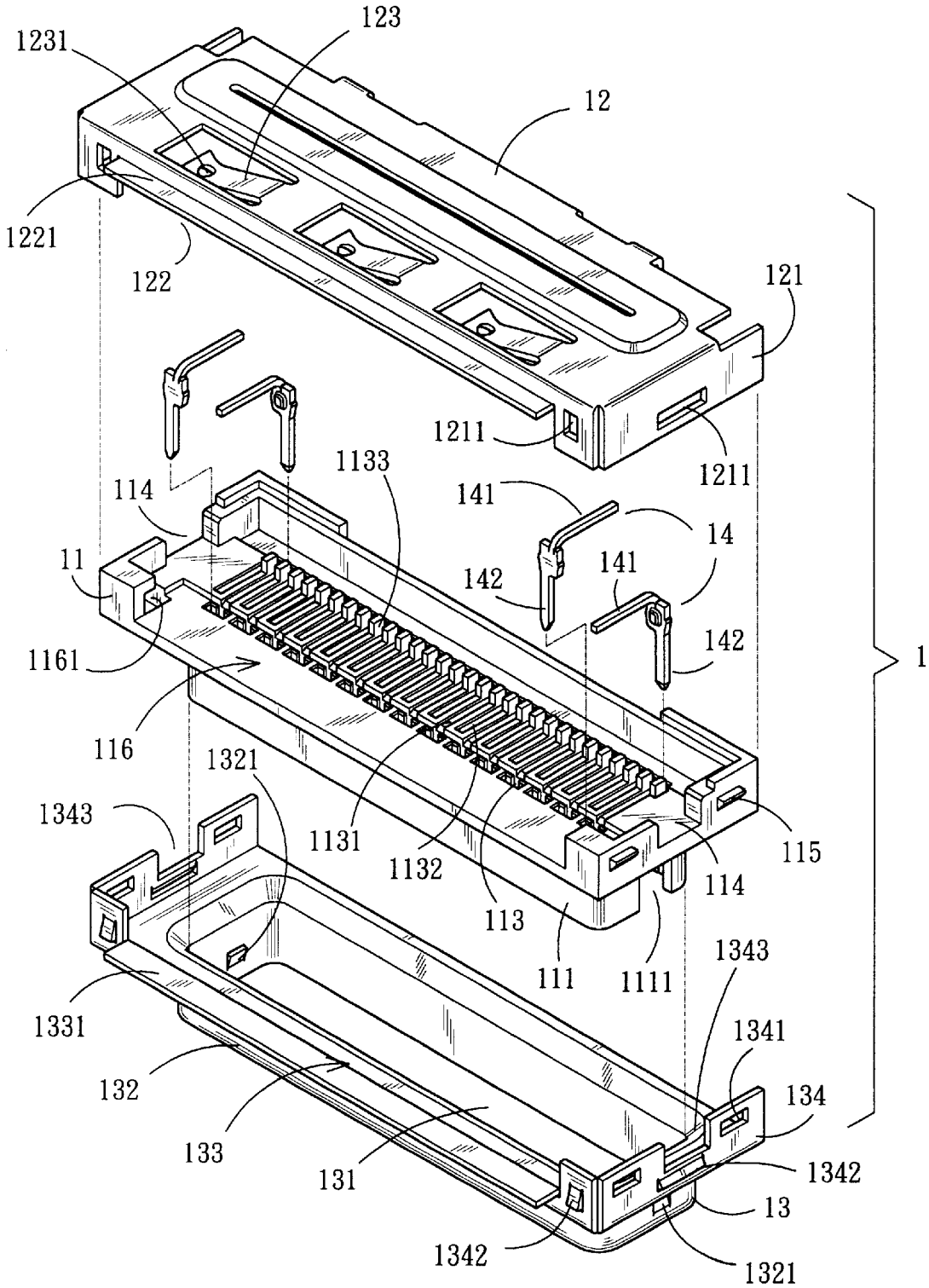
FIG. 1 is a perspective exploded view of the connector main body of the present invention.
Figure 2:
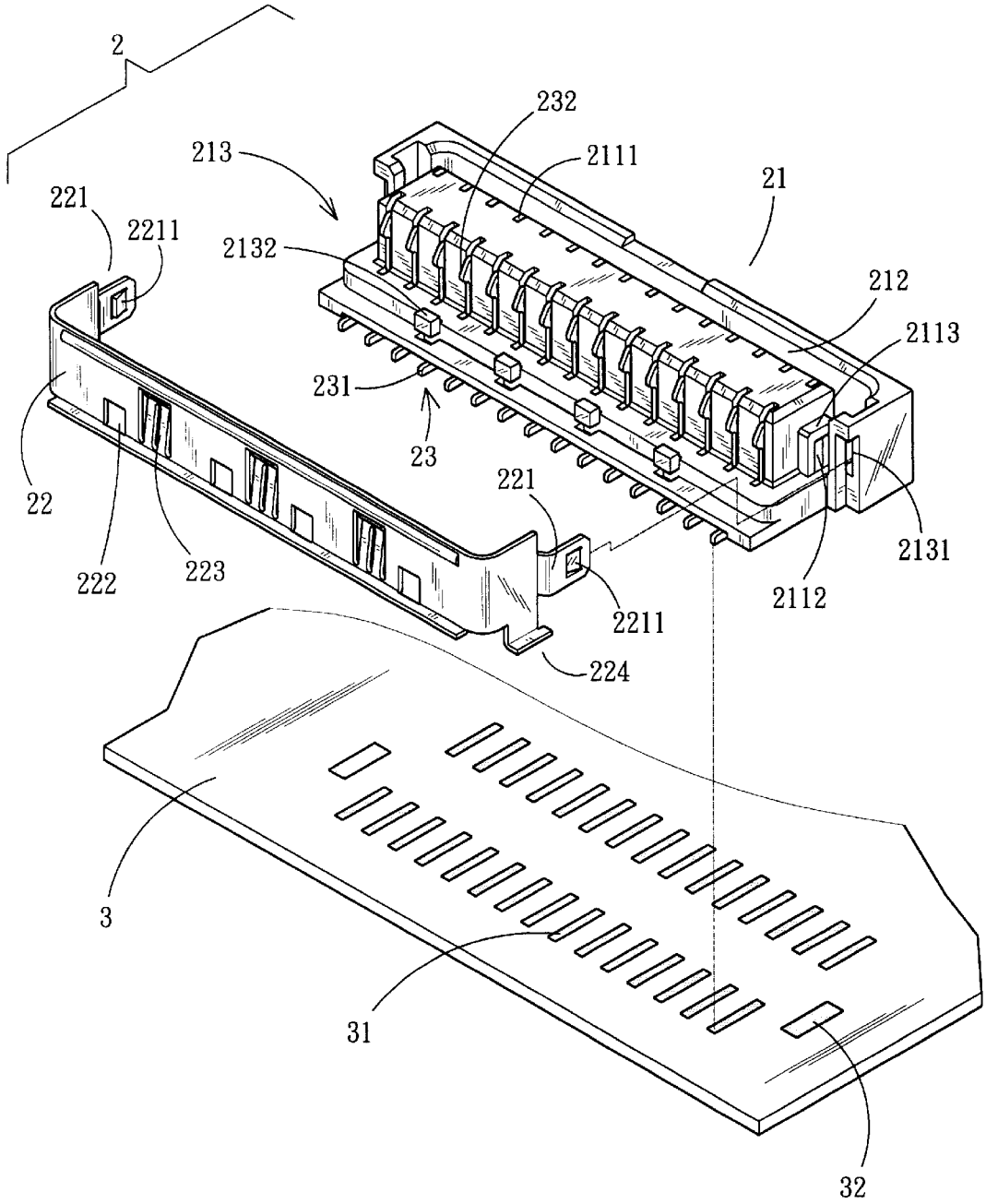
FIG. 2 is a perspective exploded view of the insertion seat of the present invention.
Figure 3:
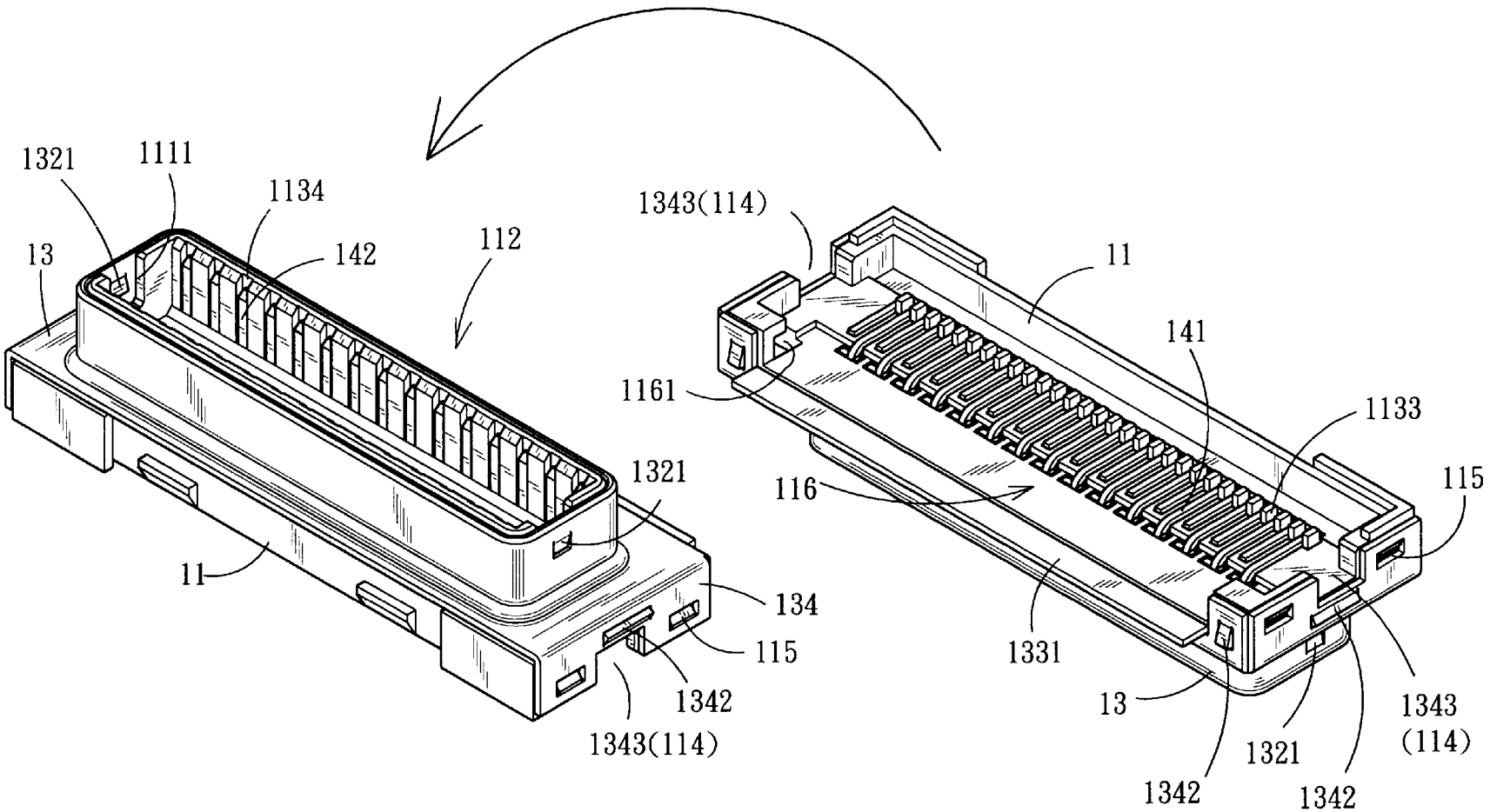
FIG. 3 is a perspective partially assembled view of the connector main body of the present invention, also showing the other side of the connector main body turned by 180 degrees.

Please refer to FIGS. 1 to 3. The present invention includes a connector main body 1 and an insertion seat 2. The connector main body 1 is composed of an insulating seat 11, an upper cover 12, a lower cover 13 and multiple terminals 14. A projecting section 111 extends from the bottom of the insulating seat 11. The projecting section 111 has a central hollow receptacle 112. The center of top side of the insulating seat 11 is formed with a recess in which multiple terminal insertion holes 113 are symmetrically parallelly arranged in lines. Opposite to the respective terminal insertion holes 113, parallel transverse channels 1131, 1132 are arranged at intervals and extend in reverse directions. A terminal separating board 1133 is disposed between each transverse channels 1131, 1132. Each terminal insertion hole 113 is downward connected with a longitudinal channel 1134 formed on inner side of the projecting section 111. An eccentric slide way 1111 is formed between the two longitudinal channels 1134, which is proximate to one side of the projecting section 111. Two notches 114 are formed on the periphery of top side of the insulating seat 11 in positions to which the lines of terminal insertion holes are directed (on the same side of the eccentric slide way 1111). A lateral opening 116 is additionally formed on the periphery of top side of the insulating seat 11 between the two notches 114. Two end sections of the lateral opening 116 are respectively formed with two engaging dents 1161. The outer periphery of the insulating seat 11 is formed with multiple engaging tenons 115. The upper cover 12 and lower cover 13 are shells with conductive and antimagnetic function. The center of the lower cover 13 is formed with a window 131. An annular skirt 132 downward extends from the periphery of the window 131 for fitting around and embracing the projecting section 111 of the insulating seat 11. A bent edge 134 upward extends from the outer periphery of the lower cover 13. A lateral opening 133 is formed on a portion of the bent edge 134 adjacent to the lateral opening 116 of the insulating seat 11. An extension slat 1331 outward extends from the bottom side of the lateral opening 133. The bent edge 134 is further formed with notches 1343 and locating holes 1341 corresponding to the notches 114 and engaging tenons 115 of the insulating seat 11. In addition, the outer periphery of the bent edge 134 is formed with multiple engaging tenons 1342. The inner periphery of the skirt 132 is provided with multiple inward projecting resilient plates 1321. The periphery of the upper cover 12 is provided with bent edge 121 for mating with the top side of the insulating seat 11. The periphery of the upper cover 12 is formed with multiple locating hole 1211 corresponding to the engaging tenons 1342 of the lower cover 13. In addition, one side of the upper cover 12 is formed with a downward extending lateral opening 122 corresponding to the lateral opening 116 of the insulating seat 11. An extension slat 1221 outward extends from the top edge of the lateral opening 122. The top face of the upper cover 12 is provided with multiple downward extending resilient contact plates 123 beside the lateral opening 122. At least one perforation 1231 is formed on free end of each contact plate 123. Each terminal 14 is substantially L-shaped, having a horizontal section 141 and a vertical section 142 which are respectively positioned on two sides from the central line. The insertion seat 2 is composed of a seat body 21, a lateral cover 22 and multiple resilient terminals 23. The seat body 21 is formed with a central projecting section 211. The periphery of the central projecting section 211 is formed with an annular insertion groove 212. One side of the seat body 21 is formed with a lateral opening 213. Two sides of the central projecting section 211 are formed with two rows of multiple slits 2111 arranged opposite to each other. Lateral projecting blocks 2113 are disposed at two end sections of the seat body 21 proximate to one side. Each lateral projecting block 2113 is formed with a central engaging dent 2112. Two ends of the seat body 21 adjacent to the lateral opening 213 are respectively formed with two insertion slits 2131. The bottom of the lateral opening 213 is provided with multiple locating tenons 2132. The lateral cover 22 is substantially U-shaped. Two ends thereof respectively have two extension sections 221. The center of each extension section 221 is punched with an obliquely extending projecting resilient plate 2211. The middle portion of the lateral cover 22 is formed with multiple locating holes 222 corresponding to the locating tenons 2132 of the seat body 21. An inward projecting lateral press board 223 is disposed between each two adjacent locating holes 222. A soldering section 224 downward extends from each end of the lateral cover 22. Each resilient terminal 23 is L-shaped, having a base section 231 and a resilient raised section 232. The resilient raised section 232 extends into the slit 2111 of the seat body 21 and laterally resiliently protrudes. The base section 231 outward parallelly extends from the bottom side of the seat body 21.

When assembled, the vertical sections 142 of the terminals 14 are inserted into the terminal insertion holes 113 of the insulating seat 11. The horizontal sections 141 of the terminals 14 extends opposite to each other. An elongated bar-shaped tool is used to downward press the terminals 14 to a fixed position. At this time, the horizontal sections 141 of the terminals 14 in the insertion holes 113 are engaged in the transverse channels 1131, 1132 and oppositely interlaced with each other. The vertical sections 142 downward extend into the longitudinal channel 1134 of inner edge of the central receptacle 112 in the projecting section 111. The projecting section 111 of the insulating seat 11 extends into the window 131 of the lower cover 13 and is held by the skirt 132. (At this time, the resilient plates 1321 of the skirt 132 extend into the eccentric slide way 1111 of the insulating seat 11.) The engaging tenons 115 are inlaid in the locating holes 1341 and located therein.

By means of the notches 114 at two ends of the insulating seat 11, a longer pressing tool can be used to press down the terminals 14 without being obstructed. Accordingly, in manufacturing, it is only necessary to use a pressing tool with sufficient length to complete the terminal pressing operation of various connector main bodies 1 with different lengths and dimensions. Therefore, the production equipment and the operation procedure can be simplified to increase production efficiency.

Figure 4:
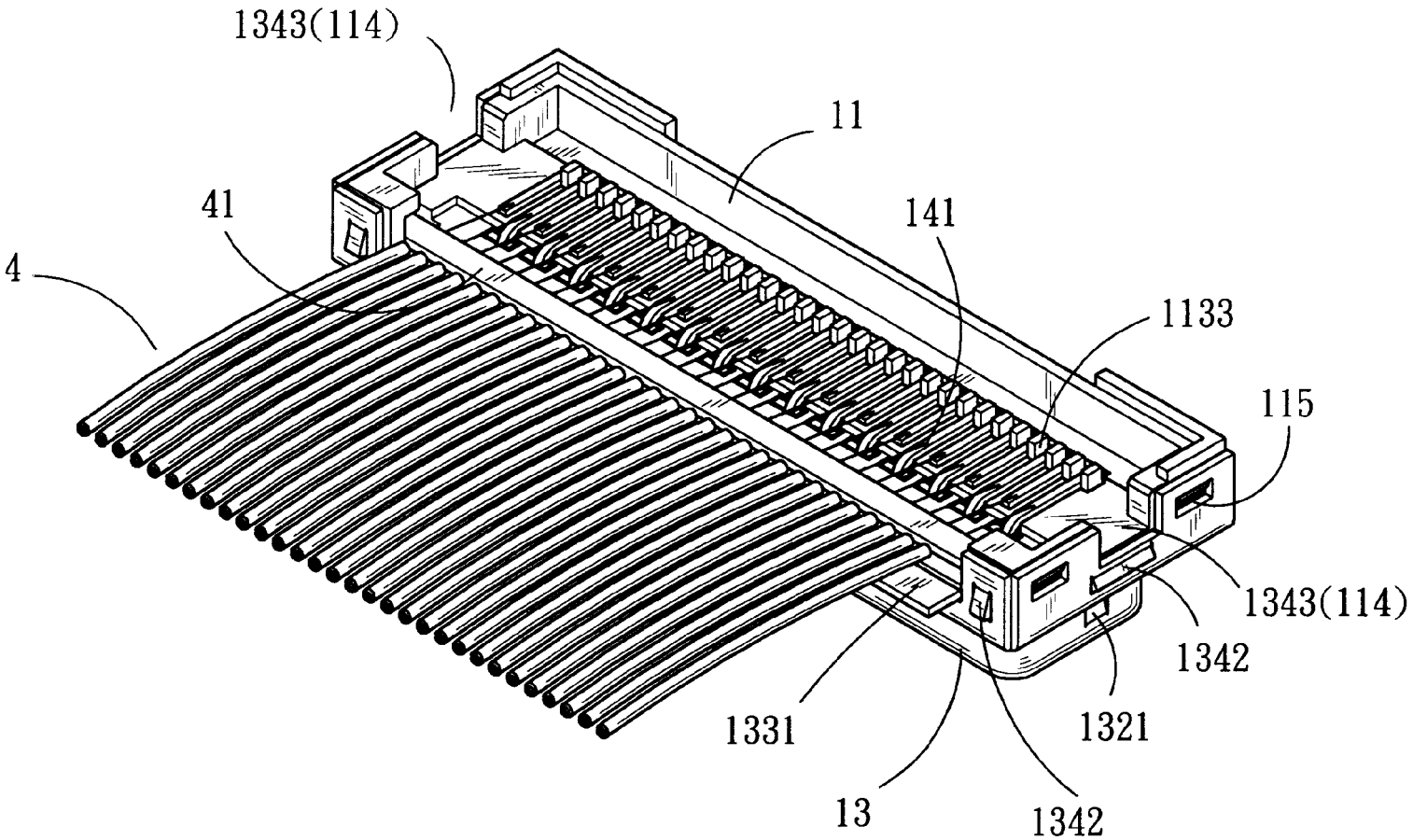
FIG. 4 is a perspective assembled view of the connector main body of the present invention and the coaxial cables.
Figure 5:
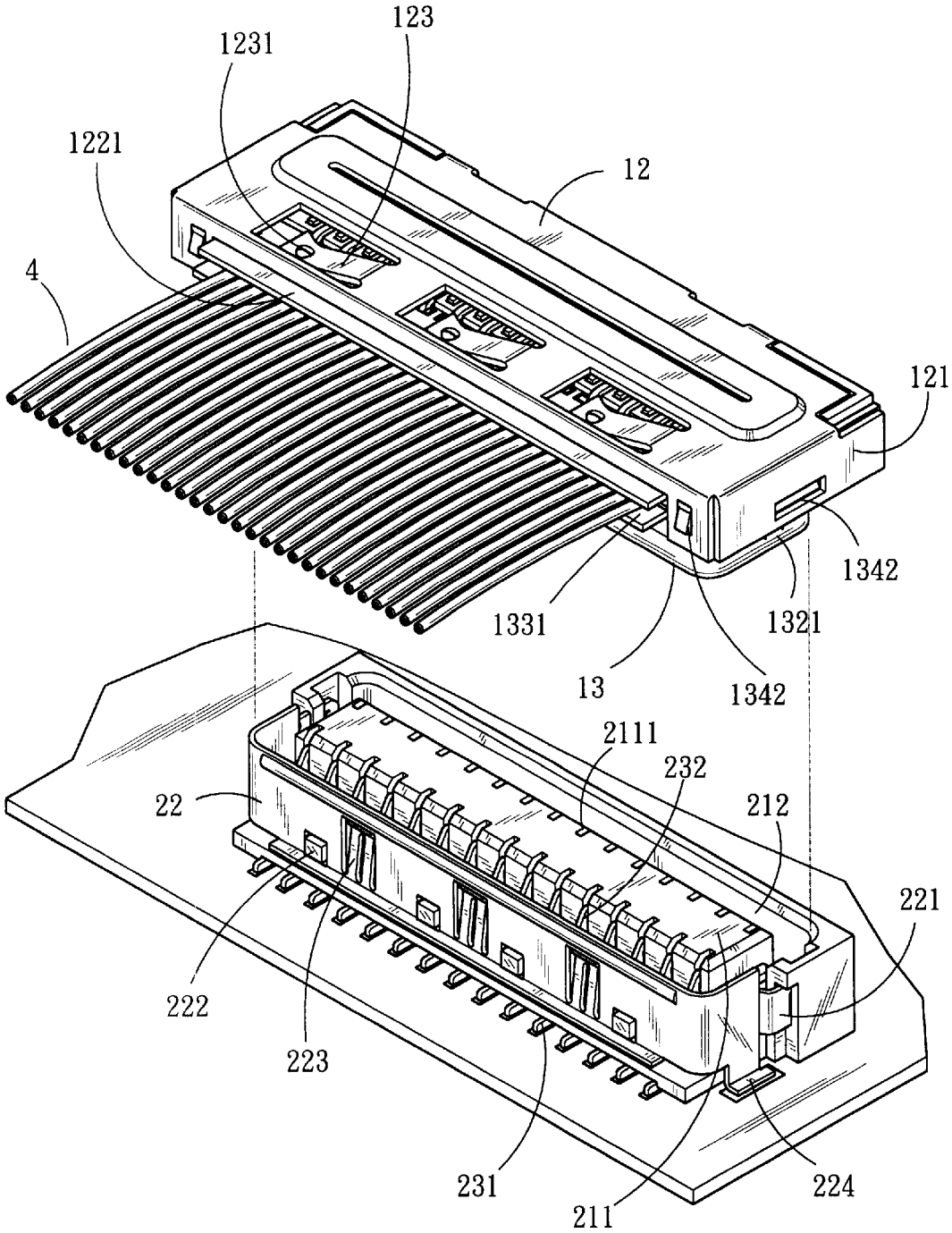
FIG. 5 is a perspective view of the connector main body of the present invention prior to being assembled with the insertion seat.
Figure 6:
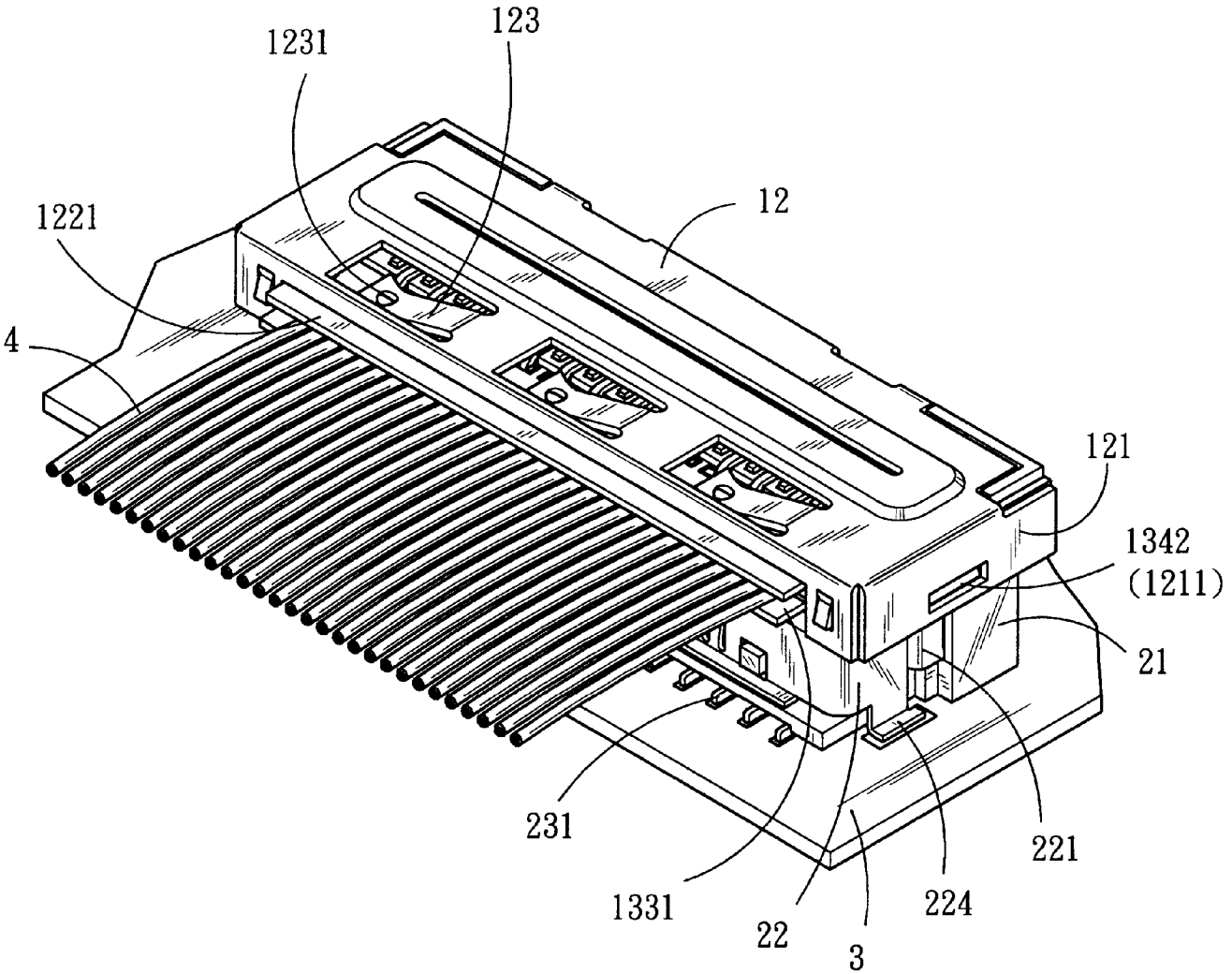
FIG. 6 is a perspective assembled view of the connector main body and the insertion seat of the present invention.

FIGS. 4, 5 and 6 show the assembling operation of the connector main body with the coaxial cable and the insertion seat in different states. In actual application, a bus of coaxial cables 4 via a grounding plate 41 are serially connected a grounding line on the surface of the coaxial cables 4. When assembled, the grounding plate 41 is positioned on inner side of the lateral opening 116 of the insulating seat 11 with two end sections inserted in the engaging dents 1161. Therefore, the signal ends of the coaxial cables 4 contact with the horizontal sections 141 of the terminals 14 and are soldered and located thereon. Accordingly, the coaxial cables 4 are prevented from being pulled out and detached by external force.

Then, the upper cover 12 is mated with the insulating seat 11 to cover the same. The engaging tenons 1342 of the lower cover 13 are inlaid in the locating holes 1211 of the upper cover 12 to associate the upper cover and lower cover with each other. At this time, the extension slat 1221 of the upper cover 12 and the extension slat 1331 of the lower cover 13 clamp the coaxial cables 4 on upper and lower sides thereof beside the grounding plate 41. This achieves an enhanced locating effect. Also, an adhesive can be additionally applied to the extension slats to fix the same. The resilient contact plates 123 of the upper cover 12 press and contact with the grounding plate 41 to electrically connect therewith. Moreover, a solder can be filled in the perforations 1231 to solder the grounding plate 41 with the contact plates 123. The extension sections 221 at two ends of the lateral cover 22 of the insertion seat 2 are inserted into the insertion slits 2131 of the seat body 21. The projecting resilient plates 2211 are engaged in the slits 2131 to locate the lateral cover 22. After assembled, the base sections 231 of the resilient terminals 23 are soldered at the terminal soldering points 31 of the circuit board 3. Also, the soldering section 224 of the lateral cover 22 is soldered at the lateral cover soldering points 32 of the circuit board 3 and grounded. Finally, the connector main body 1 and the insertion seat 2 are mated with each other with the central projecting section 211 of the seat body 21 fitted in the central receptacle 112 of the insulating seat 11. The lateral projecting blocks 2113 are fitted in the notches 114 so as to achieve both functions of slide guide and anti-idleness. When the projecting resilient plates 1321 of the skirt 132 abut against the engaging dents 2112, the main body 1 is connected with the insertion seat 2. The lateral pressing boards 223 of the lateral cover 22 resiliently press outer side of the skirt 132 to tightly abut against and ground the same. Under such circumstance, the vertical sections 142 of the terminals 14 are electrically connected with the resilient raised sections 232 of the resilient terminals 23. Accordingly, the transmission signals of the coaxial cables 4 are connected to the circuit board 3.

The eccentric slide way 1111 of the insulating seat 11 and the corresponding lateral projecting blocks 2113 of the seat body 21 are disposed in a position away from the axis. In the case that they are relatively 180 degrees rotated to a reverse position, it will be impossible to insert the insulating seat 11 into the seat body 21. Accordingly, an anti-idleness effect is achieved.

Figure 7:
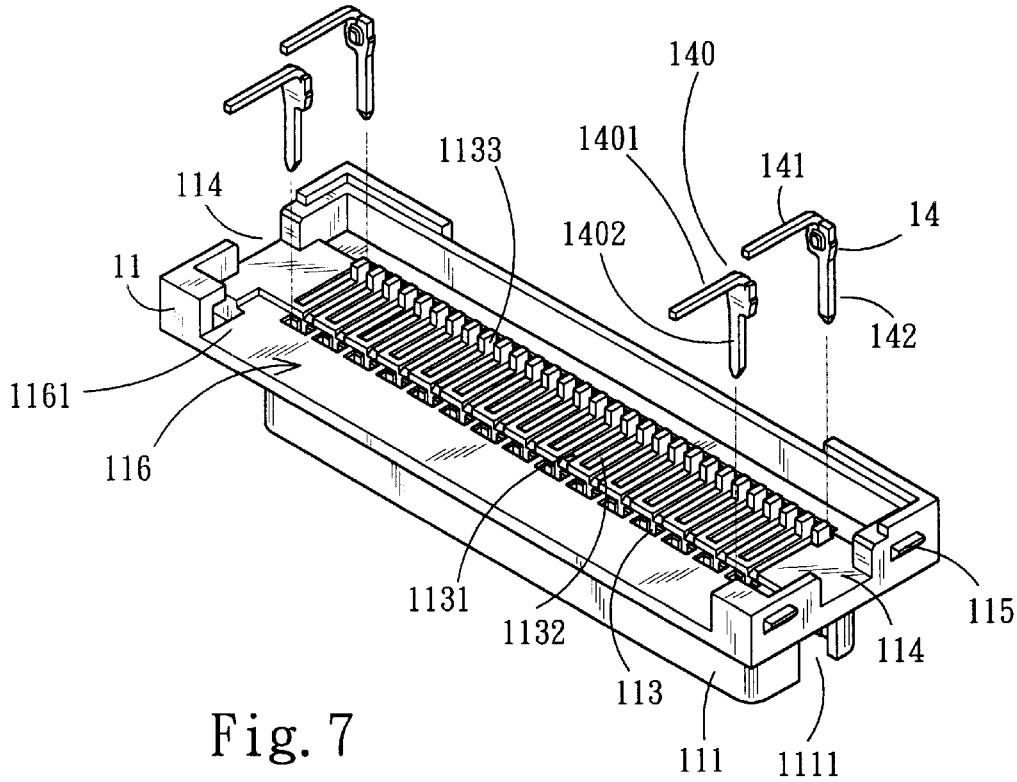
FIG. 7 shows another embodiment of the terminal of the present invention.
Figure 8:
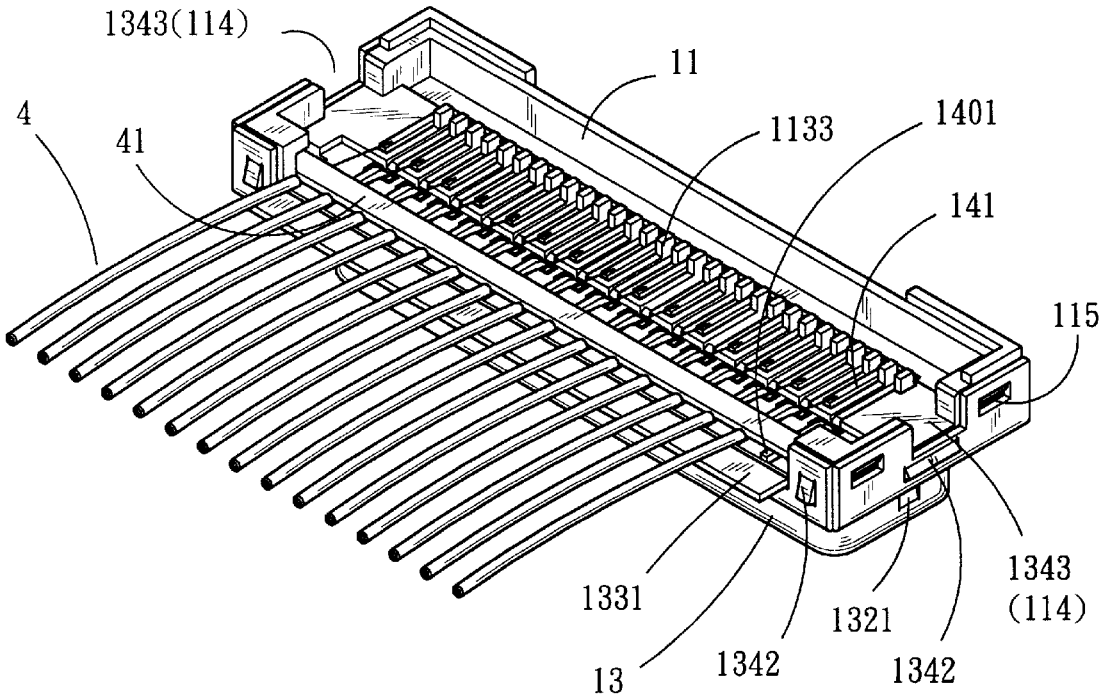
FIG. 8 is a perspective assembled view according to FIG. 7.

FIGS. 7 and 8 show another embodiment of the terminal structure of the present invention, in which a reverse terminal 140 is used. The reverse terminal 140 has a horizontal section 1401 and a vertical section 1402 which are arranged in positions and extend in directions reverse to those of the horizontal section 141 and vertical section 142 of the terminal 14. When the reverse terminals 140 are inserted in the terminal insertion holes 113 of the insulating seat 11, the horizontal sections 1401 extend in the same direction between the horizontal sections 141 of the terminals 14 (toward the lateral opening 116). When assembled, the grounding plate 401 of the coaxial cables 40 right presses the horizontal sections 1401. This embodiment is applicable to those coaxial cables 40 which are arranged relatively loosely and have different grounding patterns.

The above embodiments are only used to illustrate the present invention, not intended to limit the scope thereof. Many modifications of the above embodiments can be made without departing from the spirit of the present invention.

What is claimed is:

1. Connector which can be soldered with wire material to electrically connect therewith, said connector comprising:

an insulating seat having a hollow projecting section under bottom side for mating with an insertion seat, multiple parallelly extending longitudinal channels being formed on inner face of the projecting section, a top side of the insulating seat being formed with a central recess in which multiple opposite transverse channels are arranged at intervals, the transverse channels parallelly extending in reverse directions, the transverse channels communicating with the longitudinal channels via multiple terminal insertion holes arranged in lines on two lateral sides of the insulating seat;

multiple terminals, a middle portion of each terminal being bent, a first extension section of the terminal extending into the longitudinal channel of the insulating seat, a second extension section of the terminal upward coplanarly extending from the terminal insertion hole into the transverse channel on top side of the insulating seat for electrically connecting with the wire material; and at least one dielectric casing enclosing the insulating seat and electrically connecting with a grounding section of the wire material.

2. Connector as claimed in claim 1, wherein the outer periphery of the insulating seat is provided with multiple engaging tenons, whereby the engaging tenons can be inserted into the locating holes formed on the surface of the dielectric casing to connect the dielectric casing with the insulating seat.

3. Connector as claimed in claim 1, wherein the dielectric casing includes an upper cover and a lower cover, a center of the lower cover being formed with a window, an annular skirt downward extending from a periphery of the window for fitting around and embracing the projecting section of the insulating seat, the upper cover being mated with the top side of the insulating seat to cover the same, the upper and lower cover being formed with corresponding engaging tenons and locating holes for engaging and electrically connecting the upper and lower covers with each other.

4. Connector as claimed in claim 1, wherein each terminal is substantially L-shaped, having a horizontal section and a vertical section which are respectively positioned on two sides away from a central line of the terminal, whereby the vertical sections of the terminals can be symmetrically located in the insulating seat with the horizontal sections interlaced.

5. Connector as claimed in claim 4, wherein reverse terminals are inserted in a line of terminal insertion holes on a lateral side of the insulating seat, each reverse terminal having a horizontal section and a vertical section which are arranged in positions and extend in directions reverse to those of the horizontal section and vertical section of the terminal inserted in the other line of terminal insertion holes, whereby when the reverse terminals are inserted in the terminal insertion holes of the insulating seat, the horizontal sections of the reverse terminals extend in the same direction as the horizontal sections of the terminals.

6. Connector as claimed in claim 1, wherein the periphery of the projecting section is formed with an eccentric slide way which is proximate to one side of the projecting section, whereby when mated with the insulating seat, corresponding lateral projecting blocks of the insertion seat are guided to slide into the eccentric slide way so as to avoid mis-insertion.

7. Connector as claimed in claim 6, wherein a projecting resilient plate is disposed in the eccentric slide way of the dielectric casing and the lateral projecting block of the insertion seat is formed with a corresponding engaging dent in which the projecting resilient plate is engaged to locate the insertion seat on the dielectric casing.

8. Connector as claimed in claim 1, wherein a terminal separating board is disposed between each two adjacent transverse channels.

9. Connector as claimed in claim 1, wherein a lateral side of the periphery of the top of the insulating seat is formed with a lateral opening in a position to which the transverse channels are directed, whereby the wire material can extend through the lateral opening into the insulating seat to connect with the terminals.

10. Connector as claimed in claim 9, wherein the grounding section of the wire material is fixed with a grounding plate, two end sections of the lateral opening being respectively formed with two engaging dents, whereby two end sections of the grounding plate are inlaid and located in the engaging dents to prevent the wire material from being pulled out and detached.

11. Connector as claimed in claim 10, wherein the top face of the dielectric casing is provided with multiple downward extending resilient contact plates beside the lateral opening for resiliently abutting against and electrically connecting with the grounding plate of the wire material.

12. Connector as claimed in claim 11, wherein at least one perforation is formed on free end of each contact plate, in which a solder is filled to solder the contact plate with the grounding plate.

13. Connector as claimed in claim 9, wherein the dielectric casing are formed with two extension slats respectively adjacent to upper and lower sides of the lateral opening of the insulating seat for clamping the wire material, whereby an adhesive can be easily applied to the extension slats to fix the wire material.

14. Connector as claimed in claim 1, wherein two notches are formed on the periphery of the top side of the insulating seat in positions to which the lines of terminal insertion holes are directed, whereby a longer tool can be used to press down and locate the terminals without being obstructed.

15. Connector as claimed in claim 14, wherein the outer periphery of the insulating seat is provided with multiple engaging tenons, whereby the engaging tenons can be inserted into the locating holes formed on the surface of the dielectric casing to connect the dielectric casing with the insulating seat.

16. Connector as claimed in claim 14, wherein the dielectric casing includes an upper cover and a lower cover, a center of the lower cover being formed with a window, an annular skirt downward extending from a periphery of the window for fitting around and embracing the projecting section of the insulating seat, the upper cover being mated with the top side of the insulating seat to cover the same, the upper and lower cover being formed with corresponding engaging tenons and locating holes for engaging and electrically connecting the upper and lower covers with each other.

17. Connector as claimed in claim 14, wherein each terminal is substantially L-shaped, having a horizontal section and a vertical section which are respectively positioned on two sides away from a central line of the terminal, whereby the vertical sections of the terminals can be symmetrically located in the insulating seat with the horizontal sections interlaced.

18. Connector as claimed in claim 17, wherein reverse terminals are inserted in a line of terminal insertion holes on a lateral side of the insulating seat, each reverse terminal having a horizontal section and a vertical section which are arranged in positions and extend in directions reverse to those of the horizontal section and vertical section of the terminal inserted in the other line of terminal insertion holes, whereby when the reverse terminals are inserted in the terminal insertion holes of the insulating seat, the horizontal sections of the reverse terminals extend in the same direction as the horizontal sections of the terminals.

19. Connector as claimed in claim 14, wherein the periphery of the projecting section is formed with an eccentric slide way which is proximate to one side of the projecting section, whereby when mated with the insulating seat, corresponding lateral projecting blocks of the insertion seat are guided to slide into the eccentric slide way so as to avoid mis-insertion.

20. Connector as claimed in claim 19, wherein a projecting resilient plate is disposed in the eccentric slide way of the dielectric casing and the lateral projecting block of the insertion seat is formed with a corresponding engaging dent in which the projecting resilient plate is engaged to locate the insertion seat on the dielectric casing.

21. Connector as claimed in claim 14, wherein a terminal separating board is disposed between each two adjacent transverse channels.

22. Connector as claimed in claim 14, wherein a lateral side of the periphery of the top of the insulating seat is formed with a lateral opening in a position to which the transverse channels are directed, whereby the wire material can extend through the lateral opening into the insulating seat to connect with the terminals.

23. Connector as claimed in claim 22, wherein the grounding section of the wire material is fixed with a grounding plate, two end sections of the lateral opening being respectively formed with two engaging dents, whereby two end sections of the grounding plate are inlaid and located in the engaging dents to prevent the wire material from being pulled out and detached.

24. Connector as claimed in claim 23, wherein the top face of the dielectric casing is provided with multiple downward extending resilient contact plates beside the lateral opening for resiliently abutting against and electrically connecting with the grounding plate of the wire material.

25. Connector as claimed in claim 24, wherein at least one perforation is formed on free end of each contact plate, in which a solder is filled to solder the contact plate with the grounding plate.

26. Connector as claimed in claim 22, wherein the dielectric casing are formed with two extension slats respectively adjacent to upper and lower sides of the lateral opening of the insulating seat for clamping the wire material, whereby an adhesive can be easily applied to the extension slats to fix the wire material.

27. Insertion seat comprising:

a seat body formed with a central projecting section for mating with a connector, one side of the central projecting section being formed with an insulating wall defining an annular insertion groove, the other side of the central projecting section opposite to the insulating wall being formed with a lateral opening, two sides of the central projecting section being formed with multiple slits arranged in lines opposite to each other;

multiple resilient terminals each of which is bent and has abase section and a resilient raised section connected therewith, the resilient raised section extending into the slit of the seat body and laterally resiliently protruding to contact with opposite terminals arranged on a connector mated with the insertion seat, the base section outward parallelly extending from the bottom side of the seat body for electrically connecting with a circuit board; and a lateral cover which is a substantially U-shaped, conductive and antimagnetic shell for covering the lateral opening of the seat body, a bottom side of the lateral cover being connected with the grounding section of the circuit board, whereby when the connector is inserted, the lateral cover contacts with the dielectric casing on outer side of the connector so as to ground the connector and the circuit board.

28. Connector as claimed in claim 27, wherein the seat body is formed with multiple locating tenons beside the lateral opening, the lateral cover being formed with multiple locating holes corresponding to the locating tenons of the seat body, whereby the locating tenons are located in the locating holes to assemble the seat body with the lateral cover.

29. Connector as claimed in claim 27, wherein multiple inward extending lateral pressing boards are disposed on the lateral cover to press the dielectric casing of the inserted connector for grounding the same.

30. Connector as claimed in claim 27, wherein lateral projecting blocks are disposed at two end sections of the seat body proximate to one side, whereby when mated with the connector, the lateral projecting blocks are guided to slide into the eccentric slide way of the connector so as to avoid mis-insertion.

31. Connector as claimed in claim 30, wherein a projecting resilient plate is disposed in the eccentric slide way of the connector, while the center of the lateral projecting block is formed with a corresponding engaging dent in which the projecting resilient plate is inserted and engaged.

32. Connector as claimed in claim 27, wherein two ends of the seat body adjacent to the lateral opening are respectively formed with two insertion slits, two ends of the lateral cover being respectively formed with two extension sections, the center of each extension section being formed with an obliquely extending projecting resilient plate, whereby the extension sections can be inserted into the insertion slits with the projecting resilient plates reversely abutting against therein to achieve a locating effect.

33. Connector as claimed in claim 32, wherein the seat body is formed with multiple locating tenons beside the lateral opening, the lateral cover being formed with multiple locating holes corresponding to the locating tenons of the seat body, whereby the locating tenons are located in the locating holes to assemble the seat body with the lateral cover.

34. Connector as claimed in claim 32, wherein multiple inward extending lateral pressing boards are disposed on the lateral cover to press the dielectric casing of the inserted connector for grounding the same.

35. Connector as claimed in claim 32, wherein lateral projecting blocks are disposed at two end sections of the seat body proximate to one side, whereby when mated with the connector, the lateral projecting blocks are guided to slide into the eccentric slide way of the connector so as to avoid mis-insertion.

36. Connector as claimed in claim 35, wherein a projecting resilient plate is disposed in the eccentric slide way of the connector, while the center of the lateral projecting block is formed with a corresponding engaging dent in which the projecting resilient plate is inserted and engaged.

* * * * *